United States Patent [19]

Hämpel et al.

[11] Patent Number: 4,674,425

[45] Date of Patent: Jun. 23, 1987

[54] THREAD-CHAIN SEPARATING HEAD FOR A DOUBLE CHAINSTITCH SEWING MACHINE

[75] Inventors: Klaus Hampel, Bielefeld; Wilfried Goldbecker, Steinhagen, both of Fed. Rep. of Germany

[73] Assignee: Kochs Adler, AG, Fed. Rep. of Germany

[21] Appl. No.: 871,496

[22] Filed: Jun. 6, 1986

[30] Foreign Application Priority Data

Jun. 22, 1985 [DE] Fed. Rep. of Germany ..... 3522462

[51] Int. Cl.[4] ..... D05B 65/06

[52] U.S. Cl. ..... 112/288; 112/DIG. 1

[58] Field of Search ..... 112/DIG. 1, 288, 287; 83/100, 171

[56] References Cited

U.S. PATENT DOCUMENTS

| | | | |
|---|---|---|---|
| 2,712,805 | 7/1955 | Peterson et al. | 112/DIG. 1 X |
| 3,050,970 | 8/1962 | Billi | 112/DIG. 1 X |
| 3,159,124 | 12/1964 | Rubin . | |
| 4,020,775 | 5/1977 | King et al. | 112/287 X |

FOREIGN PATENT DOCUMENTS 1093275 11/1967 United Kingdom .

*Primary Examiner*—Werner H. Schroeder
*Assistant Examiner*—Andrew M. Falik
*Attorney, Agent, or Firm*—Laff, Whitesel, Conte & Saret

[57] ABSTRACT

A thread-chain separating head, in particular for a double chainstitch sewing machine, comprising a heating wire for thermically separating the thread chain and comprising a suction tube for leading the thread chain towards the heating wire. Said heating wire is arranged laterally and outside of the suction tube in order to achieve advantageous conditions during the heating and separating operation.

12 Claims, 9 Drawing Figures

THREAD-CHAIN SEPARATING HEAD FOR A DOUBLE CHAINSTITCH SEWING MACHINE

FIELD OF THE INVENTION

The invention relates to a thread-chain separating head, in particular for a double chainstitch sewing machine provided with a heating wire for thermically separating the thread chain, and a suction tube for leading the thread-chain to the heating wire.

BACKGROUND OF THE INVENTION

At such double chainstitch sewing machines the so-called looper thread and the so-called needle thread will be processed in the workpiece to form a thread-chain, wherein a thread-chain of such type will also be built if the workpiece has not yet reached the stitching needle or if the workpiece has already passed the stitching needle.

For the separation of threads it is known from U.S. Pat. No. 3,159,124 to arrange in the area of stitch formation a suction tube as to suck in the threads, respectively the thread-chain, and to arrange in the suction tube a heating wire in order to thermically melt off the sucked in thread. This known arrangement has the disadvantage that the heating wire will be surrounded by the sucked air and thus cooled. Due to this condition it is necessary to provide for higher heating power. Moreover, the surface temperature of the heating wire depends on the individual air flow rate of the suction tube. Danger exists in a heating wire arranged in this manner in that the sucked in thread tends too get caught or does not have a sufficiently long enough contact with the heating wire to guarantee a complete separation at a definite position.

From British patent specification No. 1,093,275 it is known to provide a cutting plate heatable by a heating element at the front end of a suction tube. This heating plate does not render possible the separation of the threads at an exactly defined position, and it requires a relative high heating power.

SUMMARY OF THE INVENTION

It is an object of the invention to construct a thread-chain separating head of the above-mentioned type in such a manner that the thread will be reliably caught, melted at an exactly predeterminable position and reliably and completely separated.

It is a further object of the invention to accomplish the separating process with a minimum of heating energy.

According to the invention the thread-chain separating head is provided with an essentially U-shape heating wire, which is arranged laterally and outside the suction tube. Due to this arrangement of the heating wire it is possible to provide a high suction rate regardless of the plane extension of the heating wire, wherein the heating wire will not be cooled directly. Thus, it is possible to operate at a constant low heating rate independently of whether the suction is applied or the vacuum device is shut off for example during the actual sewing process.

According to another modification of the thread-chain separating head the suction tube is provided with a cutout or slot being located in the position of the essentially U-shaped heating wire and opening towards the underside of the thread-chain separating head. A reliable and defined catching of the thread end is obtained by the provision of a cone-profiled portion with reduced diameter at the suction tube resulting in a Venturi tube like effect, where the velocity of flow is particularly high at this portion. Due to the provided cutout in this area, the thread will simultaneously be safely fed to the heating wire due to the force acting on the threads resulting from a continuous motion of the workpiece and the suction force.

The U-shaped heating wire achieves high efficiency and reliable catching of the thread.

According to further modifications a reliably operating thread-chain separating head allowing an unobstructed sewing operation will be achieved.

Other objects, advantages and features of the present invention will appear from the detailed description of the preferred embodiment which will now be explained in conjunction with the accompanying drawings.

DESCRIPTION OF A PREFERRED EMBODIMENT

Figure 1:
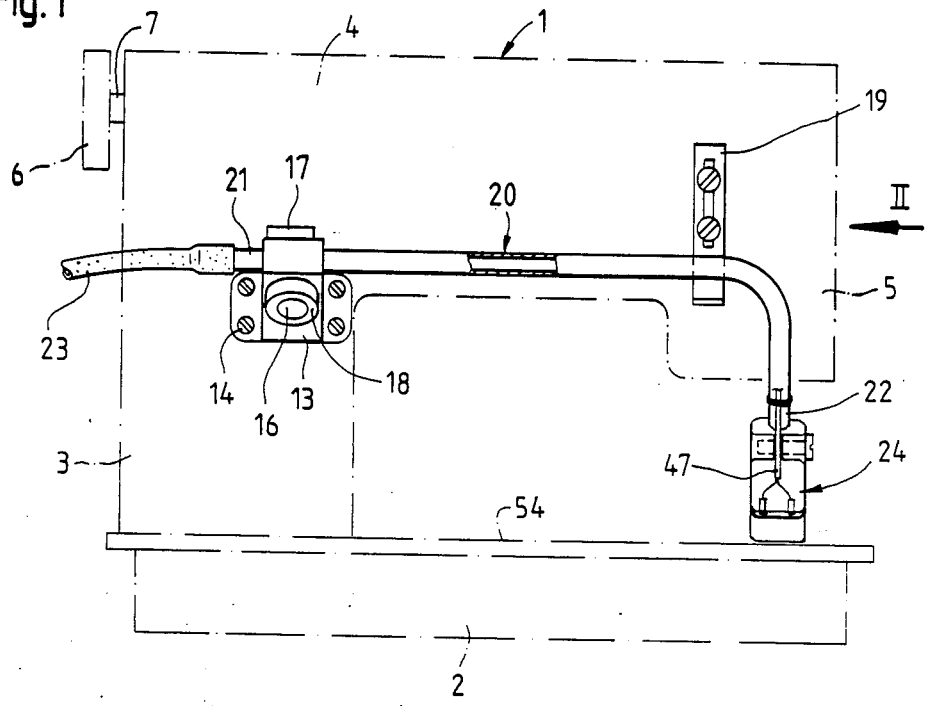
FIG. 1 is a side view of a sewing machine with a thread-chain separating head comprising a suction tube installed at the sewing machine.
Figure 5:
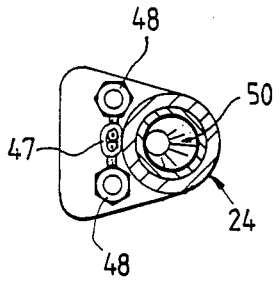
FIG. 5 is a sectional view seen in the direction of arrows V—V in FIG. 3.
Figure 6:
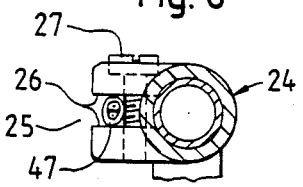
FIG. 6 is a sectional view seen in the direction of arrows VI—VI in FIG. 3, and FIGS. *7a* to *c* are sectional views corresponding to FIG. 3 of the lower part of the thread-chain separating head showing the progressing motion of a workpiece passing the thread-chain separating head.
Figure 2:
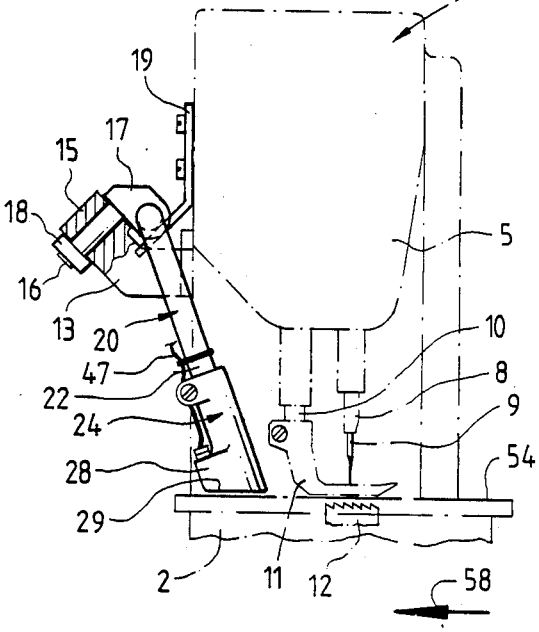
FIG. 2 is a projection of the sewing machine partially cut open as seen in the direction of arrow II in FIG. 1.

A sewing machine 1 illustrated in FIG. 1 comprises a base plate 2, a standard 3, an arm 4 and a head 5. At a free end of an arm shaft 7 there is arranged a handwheel 6. At the head 5 there is installed a needle bar 8 with a needle 9. Moreover, in the head 5 there is arranged a presser foot bar 10 with a presser foot 11. A feed dog 12 is driven in coordination with the needle bar 8, respectively the needle 9.

At the standard 3, respectively the arm 4, of the sewing machine 1 there is fastened a bearing 13 by fastening screws 14. The bearing 13 embraces at its pivot 15 an axle 16 with play. The axle 16 is part of a bearing block 17 wherein at the free end of the axle 16 is arranged a collar 18.

In the bearing block 17 there is firmly received a suction tube 20, which essentially extends in parallel to the arm 4. At the head 5 there is adjustably fastened a stop 19, on which rests the suction tube 20 with its own weight.

Onto the one trailing end 21 of the tube 20 there is pushed over a hose 23, which leads to a vacuum device (not shown) for generating suction. The other end 22 of the tube 20 is bent off for about 90° with respect to the basic body of the tube 20. The bent off part carries at its end a thread-chain separating head 24. The latter is manufactured from heat-resistant electrically non-conducting material (e.g. fiber) and is profiled with a slot 26. The thread-chain separating head 24 is pushed over the end 22 of the tube 20 and there secured by means of a screw 27, which acts on a clamping means 25.

The outer surface of the lower end 28 forms an angle W of about 70° with the normal N versus the base plate 2. The underside 29 of the thread-chain separating head 24 is positioned with respect to the base plate 2 with such a distance that an unobstructed passage of thin workpieces is assured without any problems. Generally this distance is adjustable by means of the stop 19. When sewing thicker workpieces or cross seams a yielding of the thread-chain separating head 24 away from the base plate 2 is possible.

Figure 4:
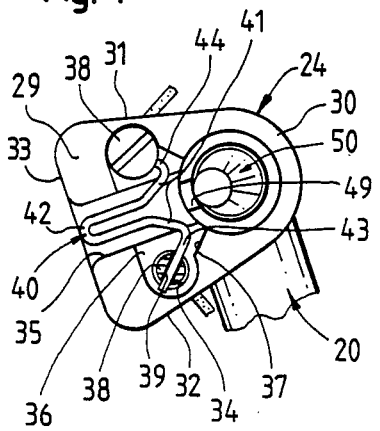
FIG. 4 is a view of the thread-chain separating head on an enlarged scale seen in the direction of arrow IV in FIG. 3.

As becomes in particular obvious from FIG. 4 the thread-chain separating head 24 is formed with a part 30 embracing the tube 20. From the part 30 there extend two shanks 31, 32, which are limited by an edge 33. In each of the shanks 31, 32 there is formed a bore 34. The shanks 31, 32 enclose a slot-profiled recess 35. The bores 34 are placed in cutouts 36, which are limited by edges 37. Into the bores 34 there are screwed in screws 38 each formed with a cross bore 39.

By means of the screws 38 a heating wire 40 is secured, wherein the ends 43 and 44 of the heating wire 40 pass through the cross bores 39 of the screws 38.

The heating wire 40 is essentially U-shaped with two U-shanks extending parallel to each other, which are connected by a bending over 180° representing a U-shaped bottom 42. The free ends 43, 44 of the U-shanks extend outwards away from the parallel U-shanks thus forming V-shaped parts 41.

Figure 3:
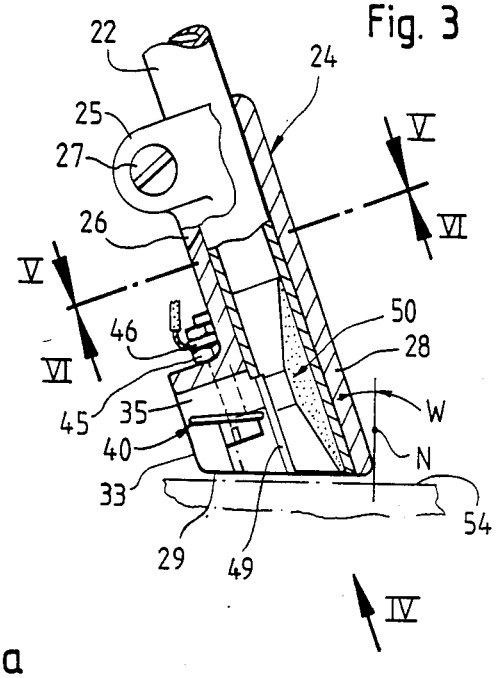
FIG. 3 is a partial sectional view of the thread-chain separating head according to FIG. 2, on an enlarged scale.
Figure 7A:
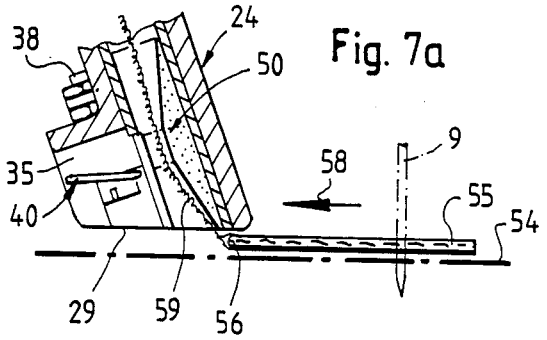
Figure 7B:
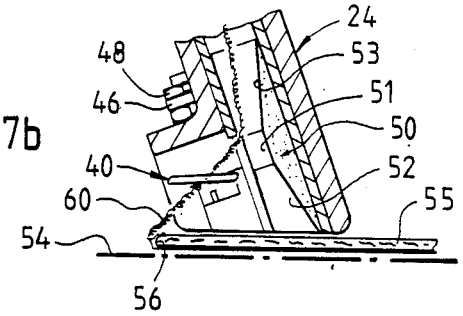
Figure 7C:
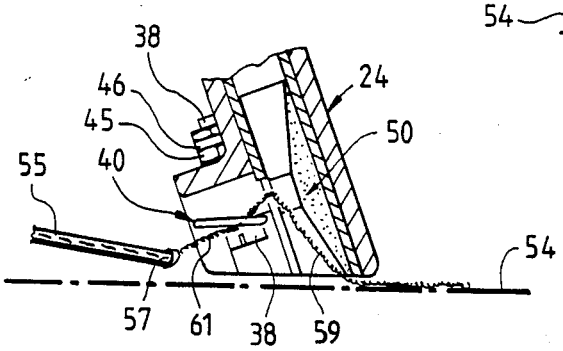

As illustrated in FIG. 3 the electric connection of the heating wire 40 is accomplished by means of a cable connection means 46 fastened by a nut 45 and a cable 47 fastened to the cable connection 46. The securing is accomplished by a nut 48.

In the area in front of the heating wire 40 the tube 20 is profiled with a slot 49, which extends from the underside 29 of the thread-chain separating head 24 to an area above the heating wire 40. In the tube 20 there is arranged an insert 50 made from plastic, which is formed such that the free cross section of the tube 20 is converging in the towards the upper end of the slot 49 and is then similarly widening out above the end of the slot 49 up to the full diameter. Thus, as seen in the section (see FIG. *7b*) two bevel-formed sections 52, 53 and a narrowed-down wall-parallel section 51 are formed in the tube 20.

Due to the construction of the tube 20 as above described and the arrangement of the narrowed-down section 51 in the area of the upper end of the slot 49 a particularly advantageous motion is achieved for the leading end 60 of a thread chain 59 in the direction towards the heating wire 40, so that a safe defined separation of the thread-chain is accomplished.

In FIGS. *7a* to *7c* there is illustrated the operation of the thread-chain separating head when separating a thread-chain of a double chainstitch sewing machine. It is assumed that the heating wire 40 is supplied with current by a power supply so that it will glow. In this condition the heating wire 40 gets a red-glowing color. The thread-chain separating head 24 may also be supplied with current such that a power supply is accomplished only during the separating phase whereas during the inactive phase—also during the generation of a seam in a workpiece 55—the power supply will be interrupted or reduced to a basic value for preheating the heating wire 40.

In the direction of arrow 58 denoted as feeding direction the workpiece 55 will be moved on the upper side 54 of the base plate 2 wherein the leading edge 56 is placed to the left according to FIGS. *7a* and *7b* and wherein the trailing edge 57 is placed to the right according to FIG. *7c*. A detailed illustration of the stitch formation at the needle is omitted.

The thread chain 59 runs in advance of the workpiece 55. The leading end 60 of the thread chain 59 will be sucked into the end 22 of the tube 20 due to the vacuum as illustrated in FIG. *7a*.

Due to the steady feeding motion, the thread chain 59 passes the slot 49 and the V-shaped parts 41 of the heating wire and gets between the parallel extending U-shanks of the heating wire 40. At this place, the thread chain 59 will be reliably separated at a devined position by a high intensity of heat due to the close distance of the U-shanks and the stress caused by the motion of the thread chain 59.

After a separation of the thread chain 59 at the leading edge 56 of the workpiece 55 the workpiece 55 will be advanced continuing the sewing process further in the direction of arrow 58 until the trailing edge of the workpiece 55 has passed the thread-chain separating head 24. In this instant—as illustrated in FIG. *7c*—the trailing edge 61 of the thread chain 59 will be sucked in and thus get into a configuration as shown in FIG. *7c* due to the above-described geometric conditions. In this configuration the trailing edge 61 of the thread chain 59 is placed almost parallel to the U-shanks of the heating wire 40 similarly to the separating operation as shown in FIGS. *7a* and *7b* by which again an increase of separating action is achieved.

What is claimed is:

1. Thread-chain separating head for a double chainstitch sewing machine, comprising an essentially u-shaped heating wire for thermically separating said thread chain; and a suction tube for leading said thread chain to said heating wire, wherein said heating wire is arranged laterally and outside of said suction tube.

2. Thread-chain separating head according to claim 1, wherein said U-shaped heating wire comprises two shanks which extend towards their free ends to form outwardly extending V-parts.

3. Thread-chain separating head according to claim 1, wherein said heating wire is arranged essentially in parallel to the plane of a workpiece and partially in parallel to the feeding direction of said workpiece.

4. Thread-chain separating head according claim 1, wherein an adjustment device for the position of said thread-chain separating head is provided.

5. Thread-chain separating head according to claim 4, wherein said thread-chain separating head is tiltable upwards out of the sewing area.

6. Thread-chain separating head for a double chainstitch sewing machine, comprising an essentially u-shaped heating wire for thermically separating said thread chain; and a suction tube for leading said thread chain to said heating wire, wherein said heating wire is arranged laterally and outside of said suction tube and wherein said suction tube is provided with a cutout or slot being located at the level of said heating wire and opening towards the underside of said thread-chain separating head.

7. Thread-chain separating head according to claim 6, wherein said U-shaped heating wire comprises two shanks extending towards their free ends forming outwards extending V-parts.

8. Thread-chain separating head according to claim 7, wherein said heating wire is arranged essentially in parallel to the plane of a workpiece and partially in parallel to the feeding direction of said workpiece.

9. Thread-chain separating head according to claim 8, wherein an adjustment device for the position of said thread-chain separating head is provided.

10. Thread-chain separating head according to claim 9 wherein said thread-chain separating head is tiltable upwards out of the sewing area.

11. Thread-chain separating head according claim 7, wherein an adjustment device for the position of said thread-chain separating head is provided.

12. Thread-chain separating head according to claim 11, wherein said thread-chain separating head is tiltable upwards out of the sewing area.

* * * * *